US006877414B1

(12) United States Patent
Minard et al.

(10) Patent No.: US 6,877,414 B1
(45) Date of Patent: Apr. 12, 2005

(54) STORAGE MAGAZINE FOR PROPELLANT CHARGE MODULES

(75) Inventors: Patrick Minard, La Chapelle Saint Ursin (FR); Philippe Gitton, Bourges (FR); Jean Cottet Dumoulin, Herry (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 10/479,061

(22) PCT Filed: May 28, 2002

(86) PCT No.: PCT/FR02/01513

§ 371 (c)(1),
(2), (4) Date: Nov. 26, 2003

(87) PCT Pub. No.: WO02/097356

PCT Pub. Date: Dec. 5, 2002

(30) Foreign Application Priority Data

May 28, 2001 (FR) ..... 01 06936

(51) Int. Cl.[7] ..... F41A 9/20
(52) U.S. Cl. ..... 89/34; 89/33.1; 89/46
(58) Field of Search ..... 89/34, 33.1, 46, 89/27.13; 42/49.01, 50

(56) References Cited

U.S. PATENT DOCUMENTS 2,494,728 A * 1/1950 Stacey et al. ..... 89/33.16
4,982,650 A * 1/1991 Bender-Zanoni et al. ..... 89/34
5,604,327 A * 2/1997 Skoglund et al. ..... 89/46
5,837,923 A 11/1998 Gay et al. ..... 89/46
5,844,163 A * 12/1998 Lindskog ..... 89/46
5,945,624 A * 8/1999 Becker et al. ..... 89/33.14
6,048,159 A 4/2000 Nicolas et al. ..... 414/416
6,170,380 B1 1/2001 Bender-Zanoni et al. ..... 89/45
6,205,904 B1 * 3/2001 Boutet et al. ..... 89/45

FOREIGN PATENT DOCUMENTS

DE 33 02 141 A1 * 7/1984
FR 2 743 412 7/1997
FR 2 743 413 7/1997
GB 80 * of 1903 ..... 89/34
GB 6949 * 3/1908 ..... 89/34
IT 400 238 * 12/1941 ..... 89/34

* cited by examiner

*Primary Examiner*—Stephen M. Johnson
(74) *Attorney, Agent, or Firm*—Parkhurst & Wendel, L.L.P.

(57) ABSTRACT

A storage magazine for propellant charge modules for artillery cannons including a set of walls delimiting compartments in which the modules are arranged in superimposed rows, such modules for removal by a pick up system, at least one mobile support for receiving a row of modules, such support in a first extraction position for filling the row and in a second storage position for removing the modules by a pick up system.

11 Claims, 7 Drawing Sheets

STORAGE MAGAZINE FOR PROPELLANT CHARGE MODULES

FIELD OF THE INVENTION

The technical scope of the present invention is that of storage magazines for modules constituting propellant charges for artillery cannons.

BACKGROUND OF THE INVENTION

An artillery cannon may be supplied either by ammunition comprising a projectile attached to a stub to form a single assembly or by ammunition comprising a projectile and propellant charge modules. In this last case, the projectile and then the different modules, whose number depends on the distance of the target under fire, must be brought into the gun chamber. The projectiles and the modules are stored in separate magazines and means are provided to bring first the projectile and then the propellant charges following known kinematics so as to be loaded in the gun chamber. These means are commonly designated as automatic pick up system.

This system is well known and does not require further explanation here. Reference may be made, for example, to patent FR-2 743 412. This document also describes a storage magazine in successive layers in the form of cylinders of the same dimension. This magazine is compartmented in rows and is provided with a transfer means to pick up the modules from a compartment. To this end, the system described incorporates an arm engaging in the selected compartment in order to transfer the modules into the loading system of the cannon.

However, the magazine described incorporates a certain number of vertical shims intended to separate the modules from one another. These shims cover the full height of the magazine.

The main drawback of this magazine lies in the difficulty in ensuring its loading with modules when all or part of the modules have been picked up. Indeed, these modules can only be introduced into the magazine by the upper part of the magazine in order to be stacked. It is therefore difficult and awkward to introduce those modules that will be placed at the bottom of the magazine. Moreover, given that these are pyrotechnic products, any impacts against the bottom or friction between the modules may well cause their ignition. Lastly, it is also difficult and awkward to renew the modules since there is little available space to access to the inside of this magazine.

SUMMARY OF THE INVENTION

The aim of the present invention is to propose a new magazine that minimises the pyrotechnic risk by introducing a new arrangement for the modules, whilst being of simple design and moderate cost.

The invention thus relates to a storage magazine for propellant charge modules for artillery cannons that comprises a set of walls delimiting compartments in which the modules are arranged in superimposed rows, such modules being intended to be removed by a pick up system, such magazine wherein it comprises at least one mobile support intended to receive a row of modules, such support in a firs extraction position ensuring the filling of the row and in a second storage position the removal of the modules by the pick up system.

According to a first characteristic of the invention, each support is in the form of a drawer mounted sliding on slides integral with a side or middle wall, such sliding drawer being immobilised on one side by a rear wall of the magazine and on the other by retractable blocking means.

According to another characteristic, the blocking means comprise an abutment plate attached to a side or middle wall and extending over substantially the full height of said wall between a hinge pin and hooking means.

According to yet another characteristic, each sliding drawer comprises reception means for the modules, these means being able to be retracted through the action of at least one spring and being able to be manoeuvred so as to place them in a position to receive the modules.

According to a first embodiment of the invention, the reception means comprises catches integral with a rod that is mounted able to pivot with respect to the drawer.

According to a second embodiment, the reception means comprise a support bar integral with at least two arms mounted able to pivot with respect to the flank of the drawer.

Each arm may be connected to the flank of the drawer by torque links formed of two hinged connecting rods.

At least one torque link may be subjected to the action of a torsional spring ensuring the rectraction of the arms.

The storage magazine may comprise at least one extractable cover integral with a mobile support.

Advantageously, each support will comprise at least two shims to position the modules.

The shims will be advantageously dimensioned so as to mask the catches or the arms when they are in their folded position.

The storage magazine will be of a substantially parallelepipedic shape, the supports being extracted at a rear face to which an operator has access.

A first advantage of the invention lies in the absence of stresses on the modules that are subjected to neither falls nor friction, which allows the pyrotechnic risk, that is the risk of accidental ignition, to be eliminated.

Another advantage lies in the ease of loading or unloading of the modules since each drawer may be easily extracted making all these operations possible.

Another advantage of the invention lies in the fact that loading is carried out horizontally.

The magazine according to the invention is of simple design and relatively moderate cost.

BRIEF DESCRIPTION OF THE DRAWINGS

Other characteristics, particulars and advantages of the invention will become more apparent from the additional description given hereafter by way of illustration and in reference to drawings, in which.

DESCRIPTION OFT HE PREFERRED EMBODIMENTS

Figure 1:
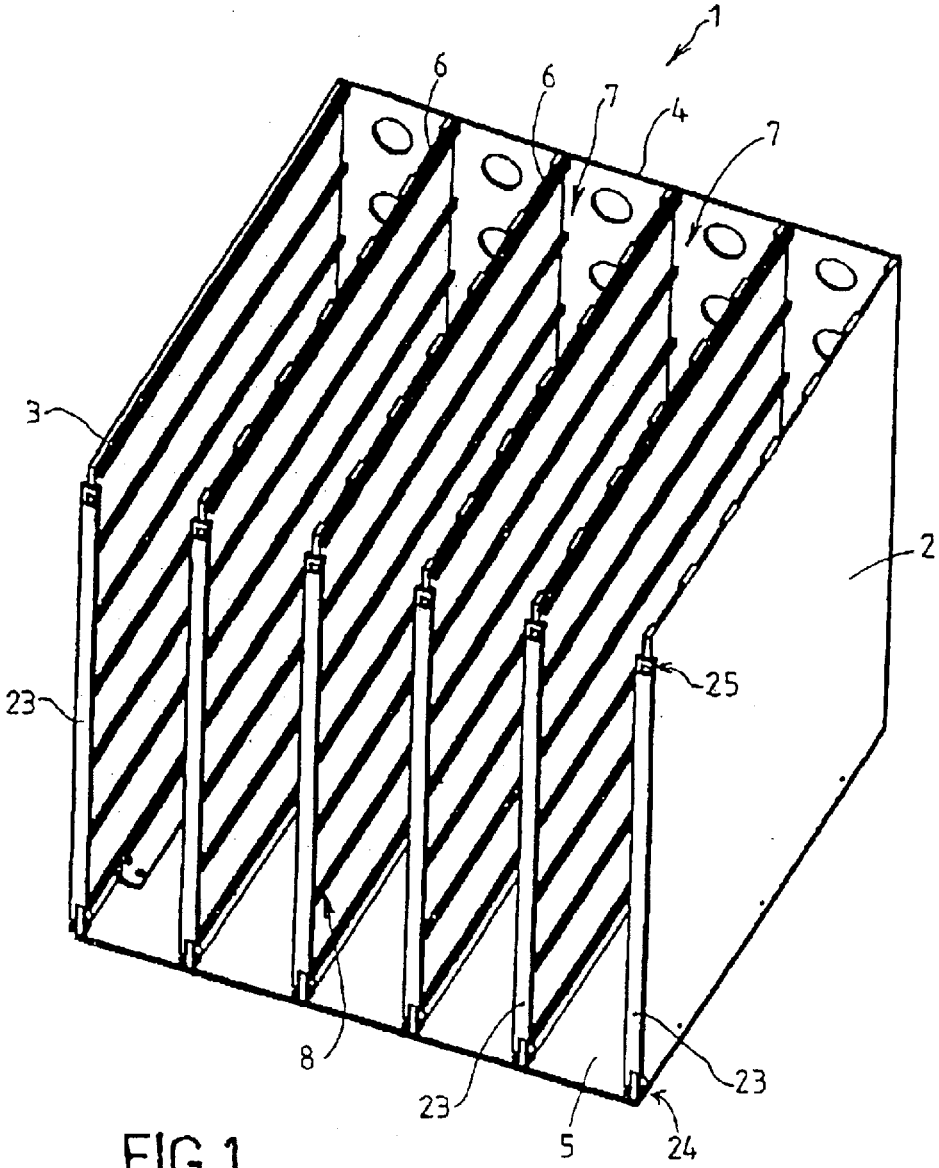
FIG. 1 is a schematic view of the make up of the magazine according to the invention.

The magazine 1 shown in FIG. 1 is in the form of a substantially parallelepipedic unit delimited by three side walls 2, 3, 4 and a bottom 5. In the plane of the figure, the walls that may be qualified as the top and front walls are missing. The inside of the magazine may be accessed by its top face to allow an automatic pick up system P of a known structure to enter, which will remove the modules stored there in order to supply a weapon. Such a system is described in the above-mentioned French patent or in patent FR-2 764 055 and may be used with the magazine according to the invention without requiring any particular adaptation.

Separating walls 6 allow the magazine 1 to be divided into a certain number of compartments 7 arranged vertically in the plane of the Figure. Side walls 2 and 3 and the separating walls 6 are equipped with slides 8 placed in parallel to the bottom 5.

Figure 2:
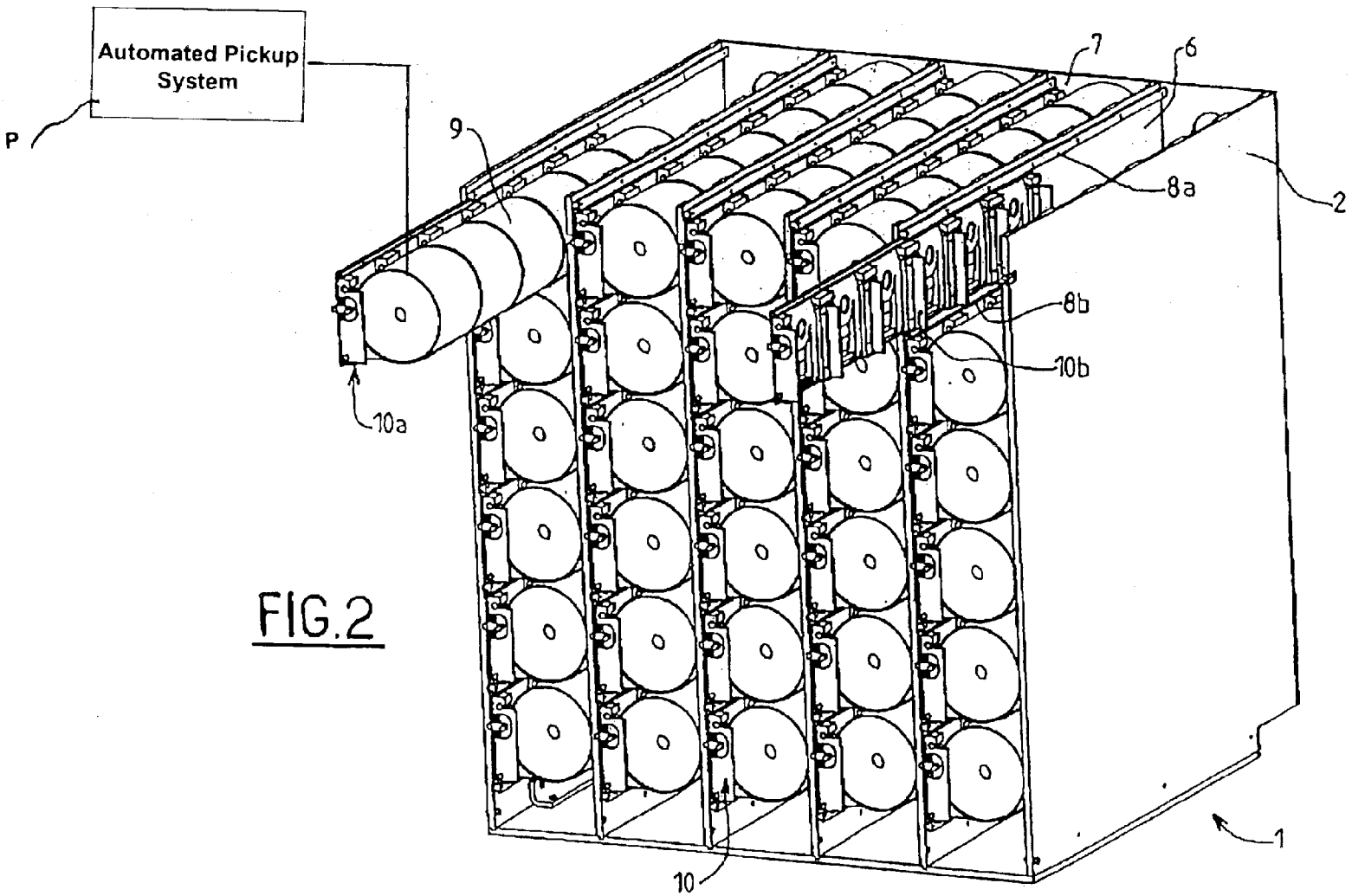
FIG. 2 shows a view of the equipped magazine filled with modules.

FIG. 2 shows a magazine 1 filled with modules 9 placed on several supports 10 that are mobile with respect to the slides 8 that are not visible in this Figure. This magazine comprises five vertical compartments 7, each enclosing six rows of modules 9, each row being supported by a support 10. Each row comprises six modules 9. The magazine 1 thus carries thirty charges that may be used by the vehicle. This data is naturally given by way of illustration only. One mobile support 10*a* carrying modules and one support 10*b* with no modules have been extracted from the Figure. FIG. 2 shows automated pick up system P for access to magazine 1.

This view shows the extraction of the support 10 in order for it to be refilled with modules after the first ones have been used. We can see that the front face, with respect to the plane of the Figure, is freed from all walls so as to allow the supports to be manoeuvred. In the Figure, we further see that each support 10 is able to move between two upper 8*a* and lower 8*b* slides, as will be explained in greater detail later.

Figure 3:
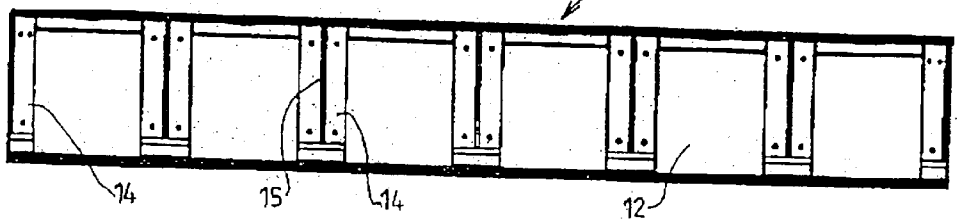
FIGS. 3 to 5 show a first embodiment of a support.
Figure 4:
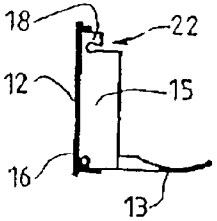
Figure 5:
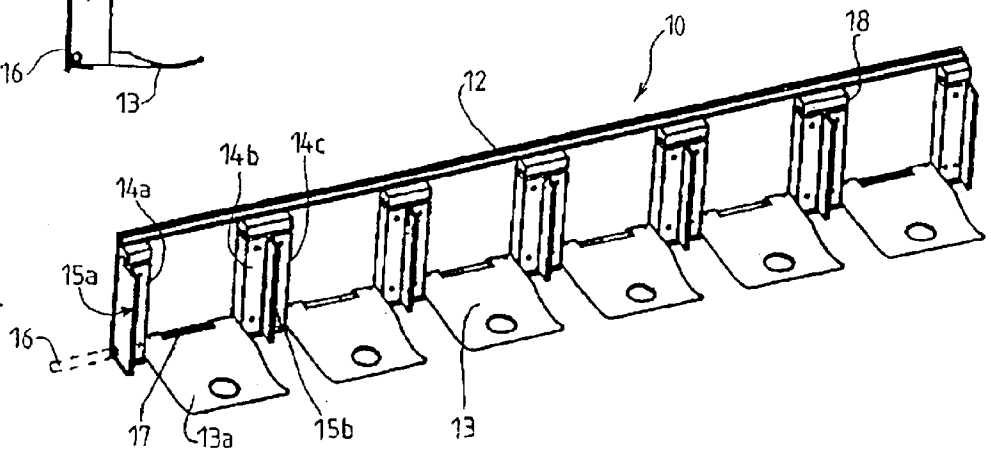

FIGS. 3 to 5 show a first embodiment of a mobile support 10 in the form of a drawer comprising a side flank 12 and catches 13. The side flank is constituted by a substantially plane plate onto which shims 14 and spacers 15 are attached so as to delimit places to receive the modules. In FIG. 3 we can see that each place is limited on either side by a shim 14.

FIG. 4 shows a transverse section of the drawer 10, made at a spacer 15. Each spacer is in the form of a plate attached, for example, by being welded to the flank 12. The catch 13 has a cylindrical profile that matches the shape of the propellant charge module.

FIG. 5 shows a perspective view of the mobile drawer 10, where we see that at both ends the spacer 15*a* backs onto a single shim 14*a* whereas each middle spacer 15*b* is placed between two shims 14*b* and 14*c*. Each catch 13 is made integral with a rod 16 by pins (not shown). To make it easier to see in FIG. 5, the rod 16 is fictively extended by dotted lines on the Figure. This rod extends over the full length of the drawer. Each catch 13 is subjected to the action of a torsional spring 17 one side of which presses on the catch 13 and the other on the flank 12 of the drawer 10. This spring brings the catch towards the flank 12 when there is no module present. The shim 14 is made thick enough to be able to entirely mask the catch 13 between two shims when it is brought back by the spring 17. This arrangement avoids interference with the modules when these are put into place or removed. To place the modules on the catches 13, only one catch needs to be pivoted. Since the catches are all integral with the rod 16, they pivot against the action of the springs 17 and adopt an open position that is substantially perpendicular to the flank 12. The springs will be sized such that the weight of a single propellant charge module is enough to hold all the catches in their open position.

The modules are in their storage position placed on the catches 13 and pressing by their cylindrical surface on the shims 14, the ends of the modules being supported by the spacers 15. The empty space between the module, the flank 12 and the shims 14 is sized so as to provide a passage for the pincer of a module pick up system (not shown). Such a system is described, for example, in patent FR-2 764 055.

In the Figure, we can see that the shims 14 are capped by a pad 18 whose role will be explained hereafter.

Figure 6:
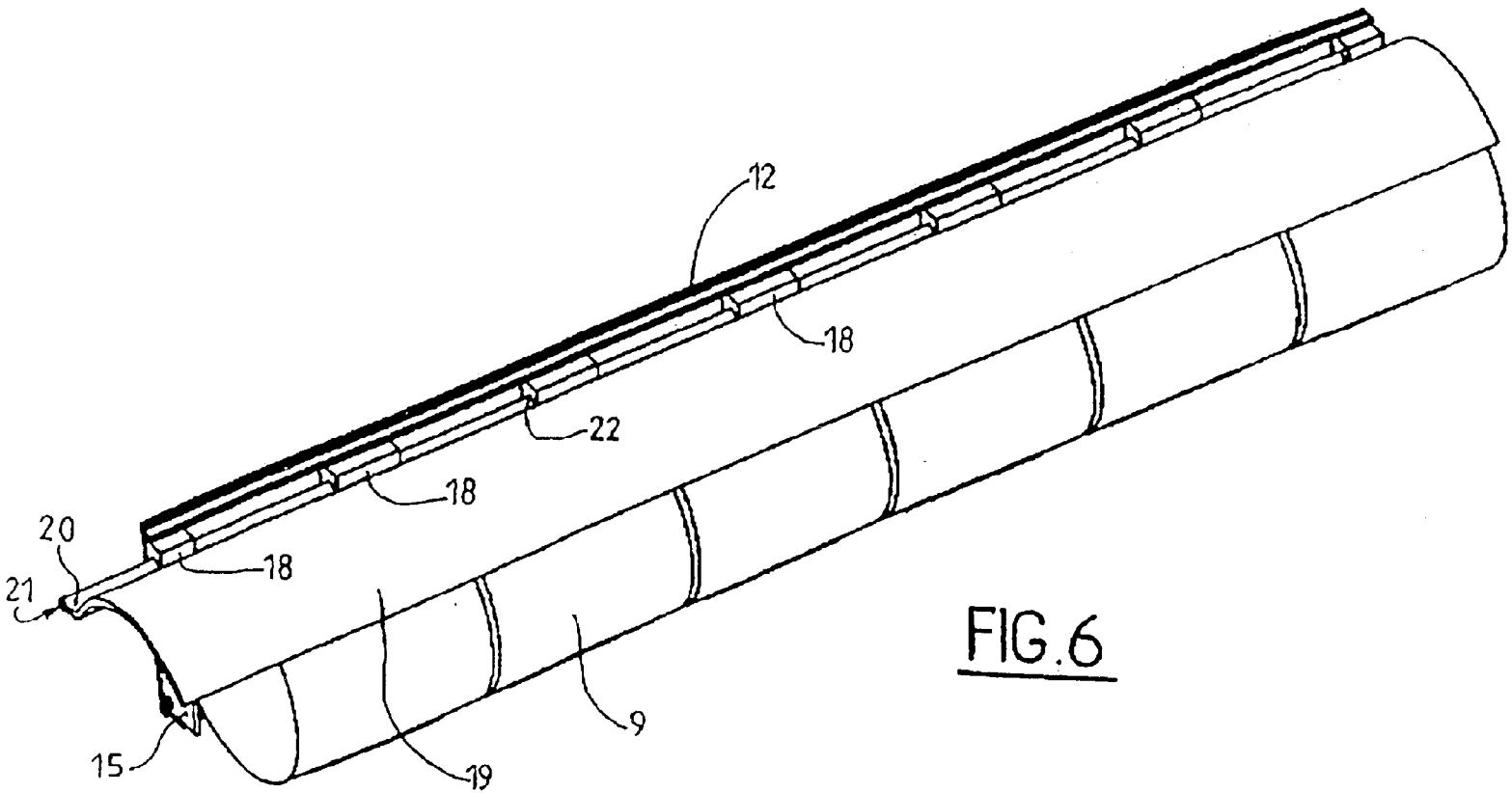
FIG. 6 is a view showing the support fitted with a cover.

FIG. 6 shows a cover 19 being put in place to protect the modules 9. This cover is mounted able to slide with respect to the flank 12. To this end, since the cover is in the overall shape of the arc of a circle it is extended by a plane border 20 finished off by a ribbed edge 21. The border 20 is engaged in the space delimited by the shims 14 and the pads 18. The lower face of the pads 18 is provided with a groove 22 in which the ribbed edge 21 engages so as to hold groove 22 in which the ribbed edge 21 engages so as to hold the cover in place whatever the movements of the magazine.

Figure 7:
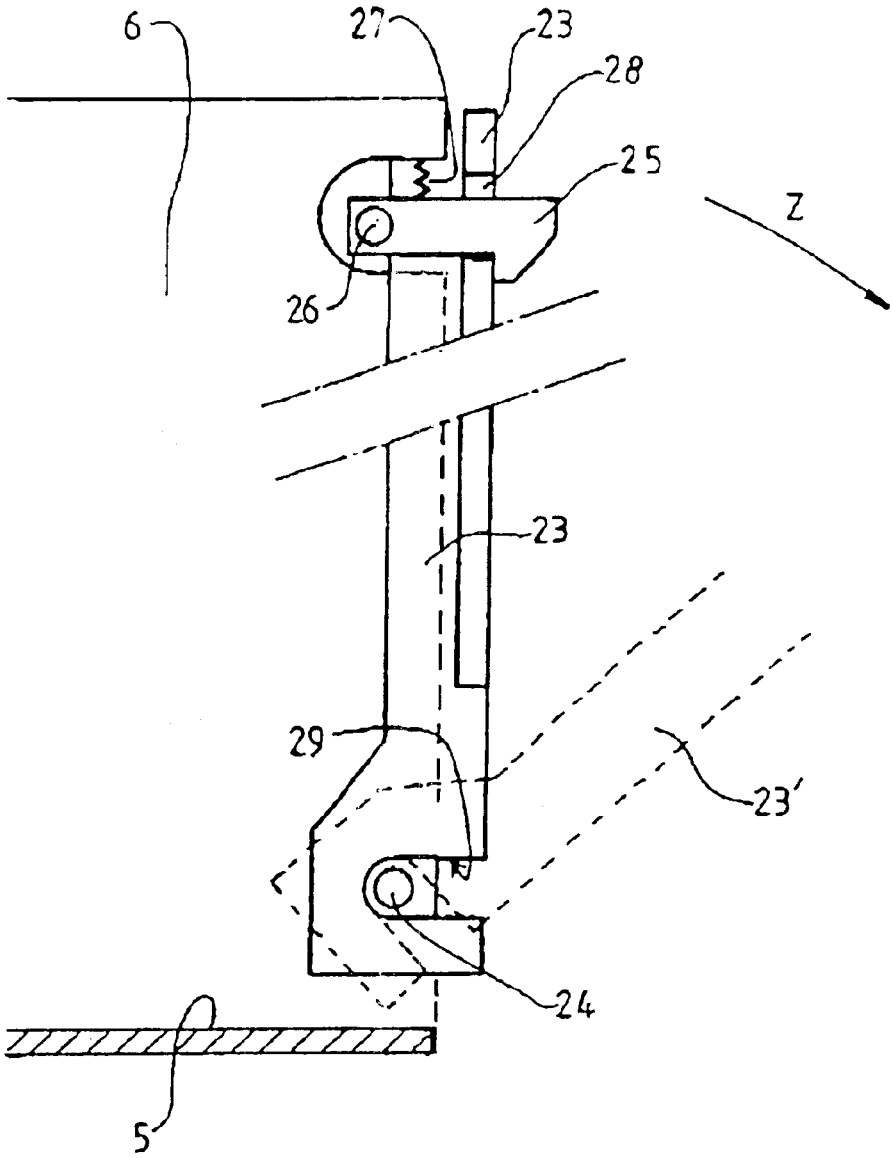
FIG. 7 is a section view of the blocking means.

The different drawers of a same vertical compartment are immobilised with respect to the magazine 2 by blocking means 23. These blocking means can be seen in FIG. 1 and in greater detail in FIG. 7.

Each of the blocking means comprises an abutment plate 23 attached to a side wall 2, 3 or middle wall 6 and extending over substantially the full height of the wall. The abutment plate is wide enough to cover the slides 8 of the different drawers 10. It therefore prevents them from coming out.

Each plate extends between a hinge pin 24 placed at the lower part of the compartment and hooking means 25.

This plate/blocking means 23 has a notch 29 in its lower part that co-operates with a spindle 24 attached, for example, to the lower part of the side (2,3) or middle 6 wall. The plate is therefore able to pivot with respect to the spindle 24 following direction Z. The plate 23 is held at its top part by a hook 25 which is itself mounted able to pivot on a spindle 26 on the wall in question and is subjected to the action of a return spring 27. This hook 25 is engaged in a slot 28 made in the plate 23 to keep it in the locked position. To release the blocking means, the hook 25 merely has to be raised so that it retracts into the slot 28 and then the plate/blocking means 23 should be made to pivot around the hinge pin 24 so as to occupy position 23' shown in dotted lines. In this position, thanks to the notch 29 it is possible to disengage the plate 23 from its hinge pin 24 and remove it. The drawers 12 of a compartment 7 are thus all released and each of them may be removed by an operator when the magazine needs to be replenished.

We note that the blocking means are provided to fix the position of all the drawers of a compartment. It goes without saying that individual blocking means may be provided for each drawer. Naturally, the length of each drawer is calculated to occupy all the space between the bottom wall 4 and the blocking means. In this way, the drawers are fully held in position between the wall 4 and the blocking means 23.

The magazine according to the invention is preferably made from metal sheets. The use of any material that is mechanically strong enough, such as reinforced plastic material, may also be envisaged.

The magazine is loaded in the following manner. The magazine is considered to be empty and closed. First of all, the hook 25 is disengaged to release the blocking means 23 which are removed. The drawers 10 of a same compartment 7 are thereby released. They are extracted and each drawer can then be filled with modules 9, starting, for example with the lower drawer.

To do this, one of the catches is lowered and a module is positioned on it. All the other catches of the drawer thereafter adopt their open position and may each receive a charge module. When six modules have been positioned in a drawer, the cover 19 is placed above the modules, the edge 21 being engaged in the groove 22 and the drawer/cover assembly is introduced into the magazine. The cover ensures the temporary maintenance of the modules during the drawer replacement operation. The cover 19 is removed once the drawer has been introduced in the magazine. Indeed, it would interfere with the catches of the drawer above and would prevent a module pick up pincer from entering the magazine.

Once all the drawers in the same compartment have been loaded, the blocking means 23 are reinstalled and pressed against the hook 25 that retracts because of the ramp with which it is fitted. These operations are carried out for each compartment until the whole magazine has been loaded. Note that when all the modules 9 of a drawer have been picked up by a pick up pincer, the catches 13 are all automatically raised under the action of the springs 17, thereby freeing the passage for the pick up pincer and allowing it to enter the drawer placed underneath. At the end of a mission, all the drawers still containing charges must be removed for safety reasons. The cover is firstly inserted on top of the highest drawer in the compartment that still carries charges, then the drawer is withdrawn and the remaining modules and removed and finally the empty drawers are replaced in the magazine.

Figure 8:
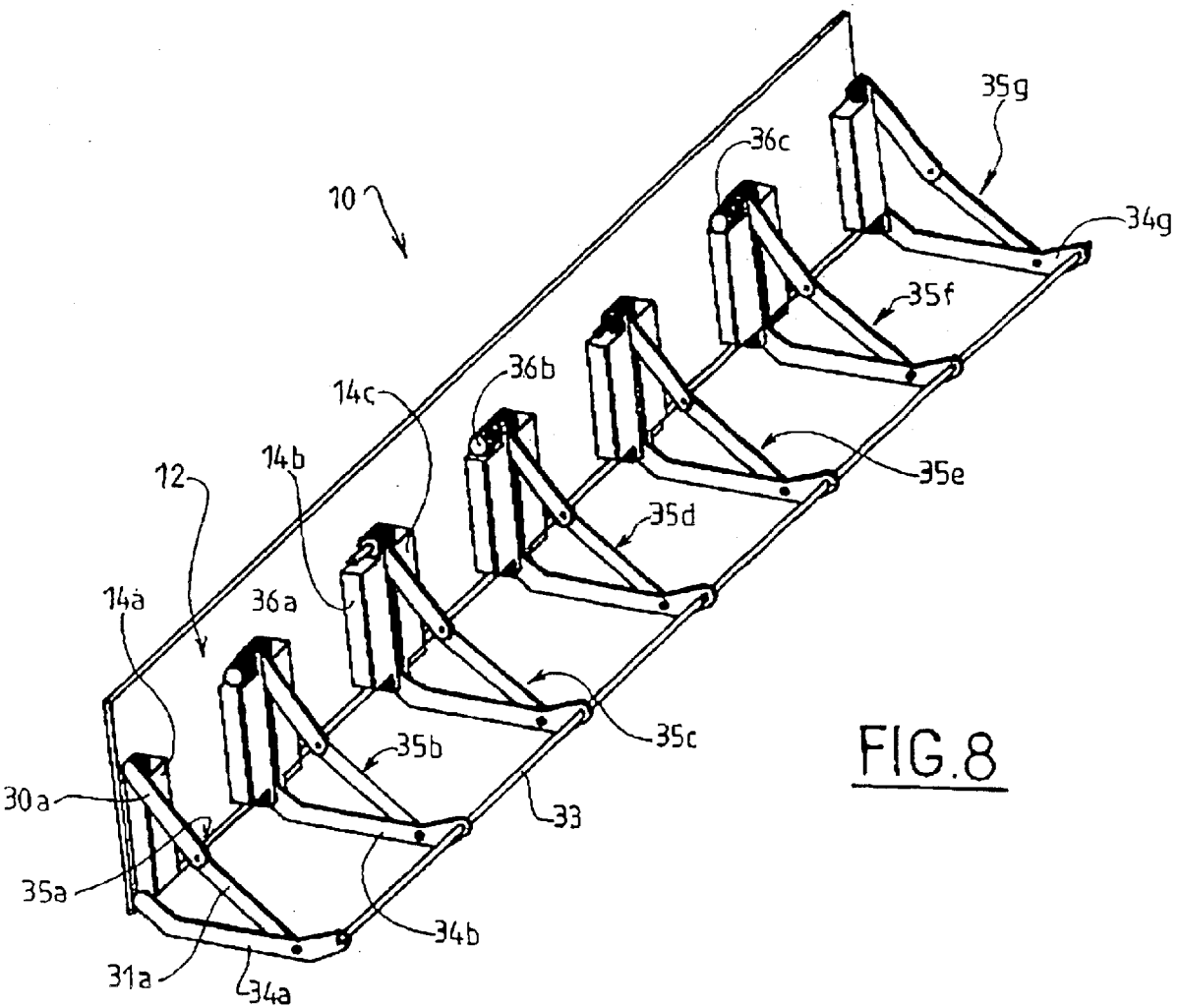
FIGS. 8 and 9 shows a second embodiment of a support.
Figure 9:
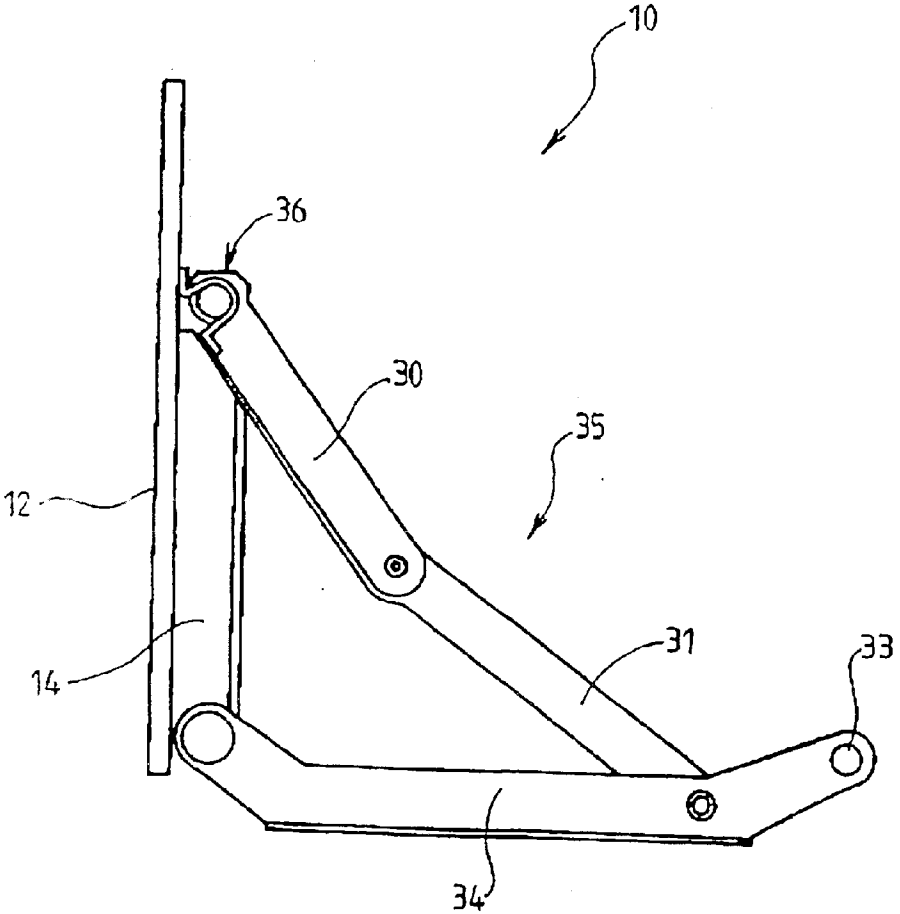

FIGS. 8 and 9 show a second embodiment of a drawer 10 of a magazine according to the invention.

This embodiment differs from the previous one in that the shims 14 do not have spacers 15 and in that the reception means do not comprise catches but a support bar 33 integral with arms (34*a*, 34*b*, 34*c*, 34*d*, 34*e*, 34*f*, 34*g*) that are mounted able to pivot with respect to the shims 14, which are integral with the flank 12 of the drawer.

Each arm 34 is connected to the flank 12 of the drawer by a torque link 35 formed by two hinged connecting rods 30 and 31.

A first connecting rod 30 is mounted able to pivot with respect to the shim 14 and a second connecting rod 31 is mounted able to pivot with respect to the arm 34. The torque link 35 unfolds when the bar 33 is lowered and each arm 34 and its torque link 35 form a side abutment for the propellant charge module (thereby fulfilling the function provided by the spacers 15 in the previous embodiment).

The bar 33, driven by the arms 34, is able to adopt a retracted position in which it is applied against the shims 14. It moves from the deployed position shown in FIG. 8 to the retracted position through the action of return springs 36 that act on one or several of the torque links 35. Here, three return springs 36*a*, 36*b* and 36*c* are provided and act respectively on torque links 35*b*, 35*d* and 35*f*. The springs are torsional springs that are placed between the connecting rod 30 of the torque link 35 and the shim 14 (see FIG. 9). They are compressed when the bar 33 is lowered and thus exert a righting torque tending to bring the bar 33 back against the shims 14.

The springs are dimensioned such that a single propellant charge module ensures the bar 33 remains in its deployed position.

The modules are held in place along two generating lines of the module, on the one hand by the bar 33 and on the other by the shims 14. In this embodiment, the propellant charge modules are held against the shims 14 whatever their diameter (within the accepted range of dimensional tolerance). The retention of the modules is thereby improved.

What is claimed is:

1. A storage magazine for storing propellant charge modules for artillery cannons, said magazine comprising:

a set of walls delimiting compartments for storing propellant charge modules in superimposed rows; and at least one mobile support for receiving one row of said superimposed rows of modules, said support locatable in a first extraction position for filling said one row and in a second storage position for removal of such modules by a pickup system, wherein said set of walls comprises side walls, at least one middle wall, and a rear wall, and the magazine further comprises a plurality of slides and retractable blocking means, wherein each mobile support comprises a drawer slidably mounted on slides on any of a side wall and a middle wall, said slidable drawer comprising one end thereof being immobilizable by a rear wall of the magazine and another end thereof being immobilizable by said retractable blocking means.

2. The storage magazine according to claim 1, further comprising a hinge pin and a locking means, wherein the blocking means comprise an abutment plate attached to any of the side wall and the middle wall and extending over substantially a full height of any of said side wall and said middle wall between the hinge pin and the hooking means.

3. The storage magazine according to claim 1, further comprising at least one spring, wherein each sliding drawer comprises retractable reception means for receiving modules, said reception means being retractable by at least one spring for movement to place the reception means in a position to receive such modules.

4. The storage magazine according to claim 3, further comprising a rod mounted for pivoting with respect to the drawer, wherein the reception means comprise catches on said rod.

5. The storage magazine according to claim 3, further comprising a support bar and at least two arms mounted for pivoting with respect to a side of the drawer, wherein the reception means comprise the support bar connected to said at least two arms.

6. The storage magazine according to claim 5, further comprising a plurality of torque links each comprising two hinged connecting rods, wherein each said arm is connected to the side of the drawer by one of said torque links.

7. The storage magazine according to claim 6, further comprising a torsional spring, wherein at least one of said torque links is connected to the torsional spring for retraction of the arms.

8. The storage magazine according to claim 1, further comprising at least one retractable cover on one of said at least one mobile support.

9. The storage magazine according to claim 1, wherein each said mobile support comprises at least two shims for positioning the modules.

10. The storage magazine according to claim 9, further comprising catches and arms, wherein the shims are dimensioned to cover any of the catches and the arms when said arms are in a folded position.

11. The storage magazine according to claim 1, wherein said magazine has a rear face for operator access and has a substantially parallelepipedic shape, and the at least one mobile support is for being extracted at said rear face.

* * * * *